US005994652A

United States Patent [19]

Umemura

[11] Patent Number: 5,994,652

[45] Date of Patent: Nov. 30, 1999

[54] PUSH BUTTON SWITCH ASSEMBLY WITH INTERLOCKING ELEMENT

[75] Inventor: Heihachiro Umemura, Sakai, Japan

[73] Assignee: Shinkoh Electric Co., Ltd., Osaka, Japan

[21] Appl. No.: 08/748,629

[22] Filed: Nov. 13, 1996

[30] Foreign Application Priority Data

Sep. 10, 1996 [JP] Japan ..... 8-261256

[51] Int. Cl.[6] ..... H01H 9/26; H01H 13/12

[52] U.S. Cl. ..... 200/5 B; 200/5 E; 200/50.36

[58] Field of Search ..... 200/5 B, 5 C, 200/5 E–5 EB, 50.32–50.4, 520–532, 539; 307/112–127

[56] References Cited

U.S. PATENT DOCUMENTS

| | | | |
|---|---|---|---|
| 2,579,168 | 12/1951 | Ballou | 200/50.36 |
| 3,271,530 | 9/1966 | Wirsching | 200/5 C |
| 3,519,766 | 7/1970 | Mackway | 200/5 E |
| 4,088,855 | 5/1978 | Emery | 200/16 A |
| 4,095,059 | 6/1978 | Nishioka et al. | 200/5 B |
| 4,122,316 | 10/1978 | Iwasaki et al. | 200/5 B |
| 5,321,311 | 6/1994 | Umemura et al. | 307/117 |
| 5,382,836 | 1/1995 | Umemura | 307/127 |
| 5,473,203 | 12/1995 | Umemura | 307/117 |
| 5,576,525 | 11/1996 | Umemura | 200/539 |
| 5,646,382 | 7/1997 | Moriya | 200/50.33 |

FOREIGN PATENT DOCUMENTS

| | | | |
|---|---|---|---|
| 52-53374 | 4/1977 | Japan | H01H 13/02 |

*Primary Examiner*—J. R. Scott
*Attorney, Agent, or Firm*—Wenderoth, Lind & Ponack, L.L.P.

[57] ABSTRACT

A push-button switch of simple structure and highly reliable operation capable of safely stopping equipment even when the push button of the push-button switch fails to return to its normal position while the push-button switch for operating equipment is being operated. And a push-button switch device capable of easily judging the presence or not of any failure of the push-button switch for operating the equipment by using that push-button switch. In a pushbutton switch in which the push button is provided, in a way to be available for pressing down in resistance to a spring for returning the push button, on a breaker plate provided with a fixed contact for an operating circuit and a fixed contact for a verification circuit, the push button is composed of push button body and auxiliary push button body slidably disposed against the push button body, the push button body is provided with a mobile contact for the operating circuit and the auxiliary push button body is provided with a mobile contact for the verification circuit respectively, and the push button body is urged in the returning direction with a spring for returning the push button body.

2 Claims, 11 Drawing Sheets

PUSH BUTTON SWITCH ASSEMBLY WITH INTERLOCKING ELEMENT

BACKGROUND OF THE INVENTION

The present invention relates to a push-button switch of simple structure and highly reliable operation and a push-button switch device using such a push-button switch.

Conventionally, in a push-button switch device such as a pendant push-button switch device, used for a hoist crane, for example, a push-button switch is provided, in addition to a contact for an operating circuit for operating equipment (Contact A), with a contact for a verification circuit for verifying the state of return of the push-button switch, for example, the open state of the contact for the operating circuit at the time of closing of power, (Contact B). Note, for example, Japanese Utility Model Publication No. 52-53374.

This push-button switch is constructed in such a way that, by being incorporated in a push-button switch device provided with a sequence circuit consisting of operating circuit 7 and verification circuit 8, as shown in FIG. 12, for example, the main electromagnetic contactor MCO is not turned ON even if the power closing switch PB1 is operated in the state where the push button of the push-button switch does not release for reasons of failure of the push-button switch. It is believed that most incidents due to biting of dust (hereinafter referred to simply as "failure of the push-button switch" in the state where at least one of the contacts for the operating circuit is closed. In this case, the contact for the verification circuit corresponding to the closed contact for the operating contact is in the open state.

It is believed that most incidents of the push button of a push-button switch not releasing is believed to be produced more often because of a breaking of the spring for returning of the push button, or locking of the push button as a result of biting of dust in the sliding part of the push button, when the push button of a push-button switch for operating equipment is released from the pressed state, rather than when the push-button switch is out of operation.

However, in the case of a push-button switch device incorporating the conventional push-button switch, because the contact for the operating circuit remains closed when the pressed push button of a push-button switch cannot return when the push-button switch is being operated for operating equipment, (in other words, in the state where the main electromagnetic contactor MCO is turned ON), it is necessary for the operator to operate the switch PB2 for shutting off the power source to stop the equipment. However, in a pendant push-button switch device used for a hoist crane, for example, the operator cannot fully follow the movement of the pendant push-button switch device because the pendant push-button switch device moves together with the hoist crane and therefore cannot manage to operate the switch PB2 for shutting off the power source, thus presenting a risk of reckless use of the hoist crane without any means for preventing such eventuality. For that reason, a push-button switch device incorporating conventional push-button switches could not always fully achieve the purposes of raising the reliability of push-button switch operation and improving the safety of operation of the equipment as originally intended to.

Moreover, in the case of a push-button switch device provided with a conventional sequence circuit consisting of an operating circuit 7 and verification circuit 8, as shown in FIG. 12, there was a problem that the presence or not of any failure of the push-button switch for operating the equipment cannot be judged unless either the main electromagnetic contactor MCO is not turned ON even if the switch PBI for closing power is operated or the equipment does not stop even when the push button of the push-button switch for operating the equipment is released from the pressed state.

SUMMARY OF THE INVENTION

The object of the present invention is to provide, in view of the problems of conventional push-button switches, a push-button switch of simple structure and highly reliable operation, capable of safely stopping equipment even in cases where the push button of the push-button switch fails to return to its normal position while the push-button switch for operating equipment is being operated, and a push-button switch device capable of easily judging the presence or not of any failure of the push-button switch for operating the equipment by using that push-button switch.

To achieve this object, the push-button switch of the present invention is realized as a push-button switch in which the push button is provided, in a way to be available for pressing down in resistance to the spring for the returning push button, on a breaker plate provided with a fixed contact for the operating circuit and a fixed contact for the verification circuit, characterized in that the push button is composed of a push button body and an auxiliary push button body slidably disposed against the push button body, that the push button body is provided with a mobile contact for the operating circuit and the auxiliary push button body is provided with a mobile contact for the verification circuit respectively, and that the push button body is urged into the return direction with a spring for returning the push button body.

According to the push-button switch of the present invention, the push button is composed of a push button body provided with a mobile contact for the operating circuit and an auxiliary push button body slidably disposed against the push button body and provided with a mobile contact for the verification circuit respectively, and the push button body is constructed in such in a way as to be urged into the returning direction with a spring for returning the push button body that is separate from the spring for returning the push button. With this construction, because the push button body provided with a mobile contact for the operating circuit returns to its normal position with the urging force of the spring for returning the push button body even when the auxiliary push button body of the push button of the pressed push-button switch fails to return, in the state where the main electromagnetic contactor is ON, the contact for the operating circuit is opened and it becomes possible to automatically stop the equipment, thus increasing the reliability of the motion of the push-button switch and improving the safety of the equipment in operation.

Moreover, the push-button switch device of the present invention is realized as a push-button switch device incorporating a plural number of the push-button switches of the present invention, characterized in that the indicating lamp for verification is interposed in the verification circuit constructed by connecting the fixed contacts for the verification circuit of the respective push-button switches in series.

According to the push-button switch device of the present invention, in which the indicating lamp for verification is interposed in the verification circuit constructed by connecting the fixed contacts for the verification circuit of the respective push-button switches in series, it becomes possible to judge the presence or not of any failure of the push-button switch for operating equipment prior to the occurrence of a situation where the equipment does not stop, even if the push button of the push-button switch for operating the equipment is released from its pressed state, because the indicating lamp for verification does not light upon the occurrence of anything unusual in the returning state of the push button of the push-button switch in the state where the main electromagnetic contactor is ON, thus enabling further improvement of the safety of the equipment in operation.

DETAILED DESCRIPTION OF THE INVENTION

Figure 1A:
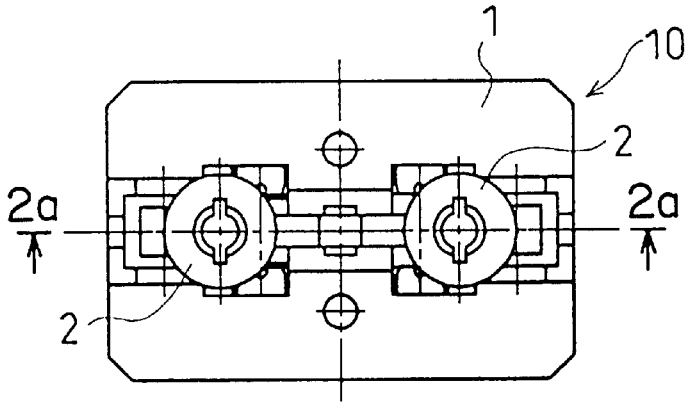
FIGS. 1(*a*)–1(*d*) indicate the first example of the push-button switch of the present invention, FIG. 1(*a*) being a plan view, FIG. 1(*b*) a front elevation, FIG. 1(*c*) a bottom view, and FIG. 1(*d*) a side view.
Figure 1B:
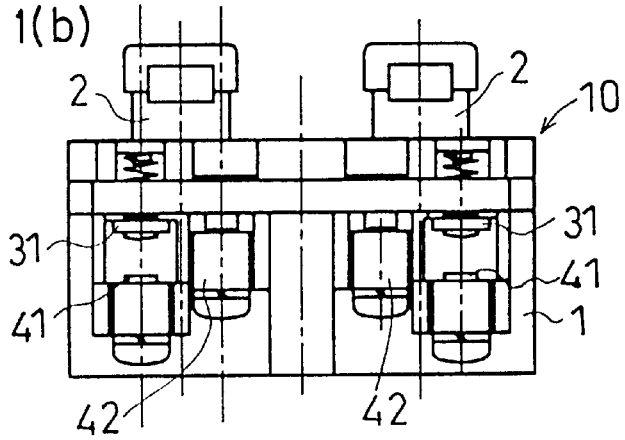
Figure 1C:
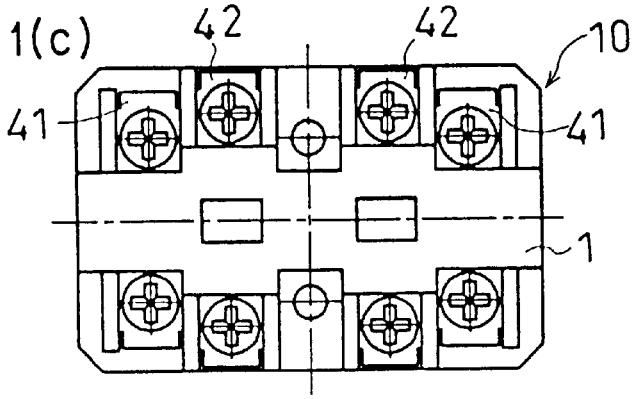
Figure 1D:
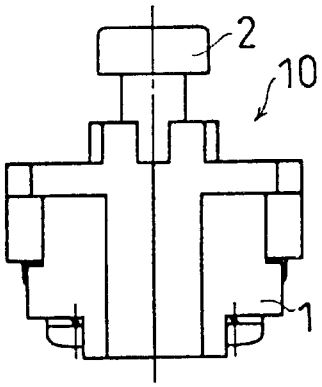
Figure 2A:
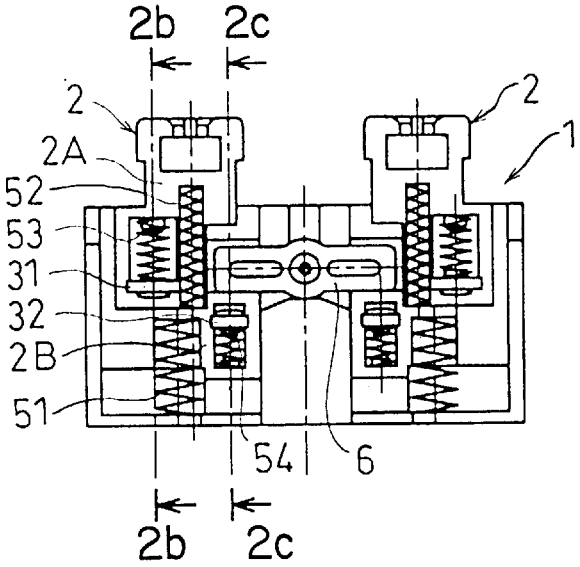
FIG. 2(*a*) is a sectional view of line 2*a*—2*a* of FIG. 1(*a*), FIG. 2(*b*) is a sectional view of line 2*b*—2*b* of FIG. 2(*a*), and FIG. 2(*c*) a sectional view of line 2*c*—2*c* of FIG. 2(*a*).
Figure 2B:
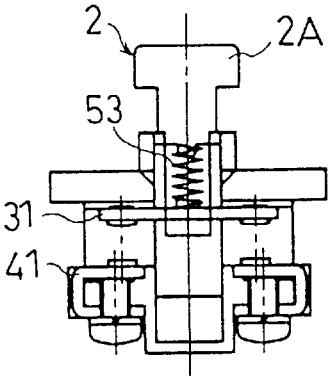
Figure 2C:
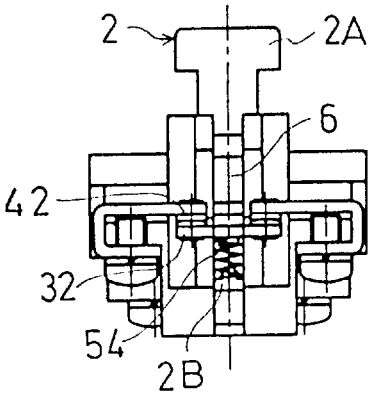
Figure 3:
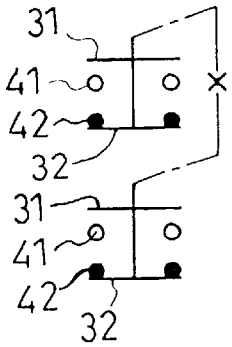
FIG. 3 is a contact drawing of the first example of the push-button switch of the present invention.
Figure 4:
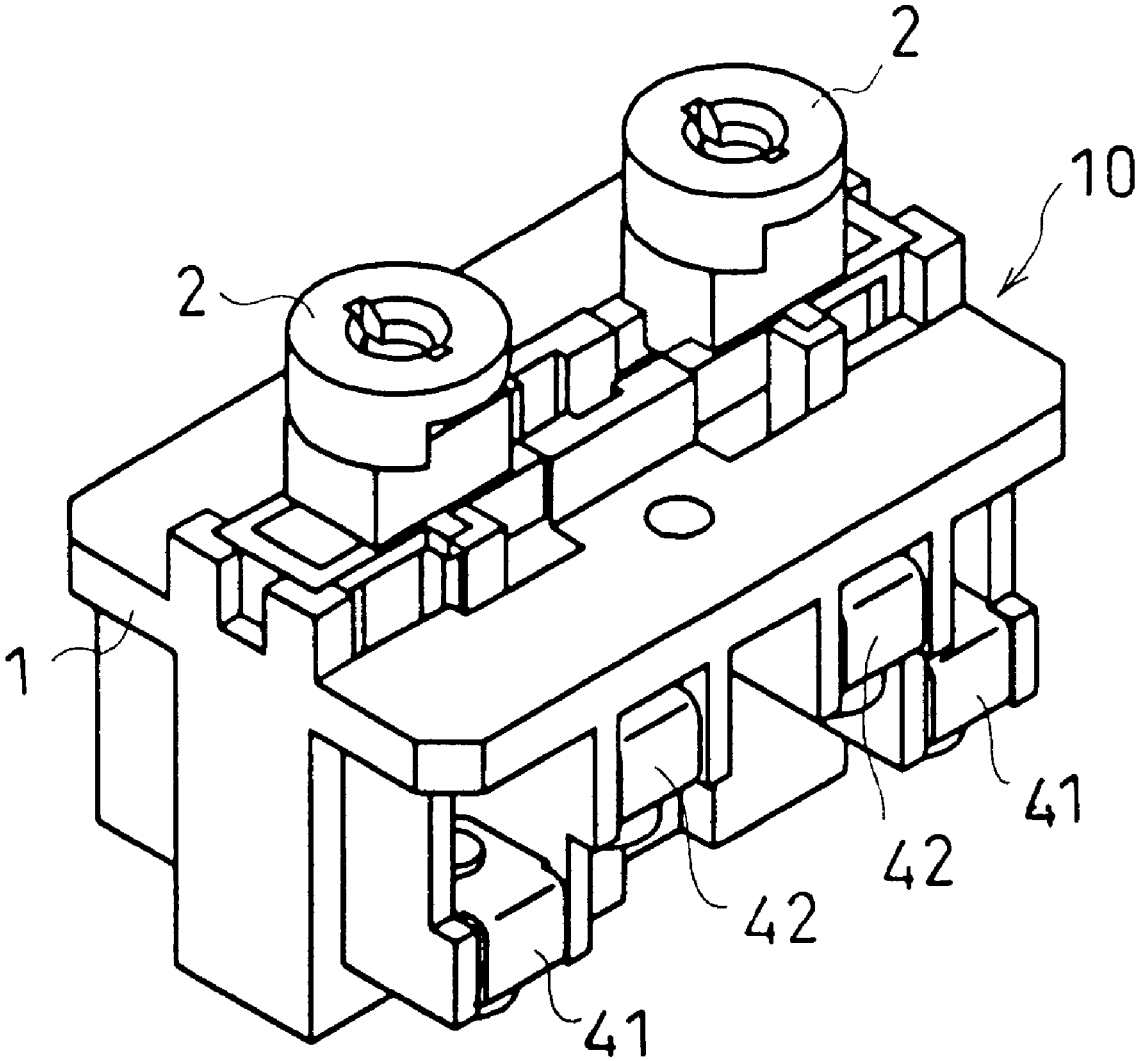
FIG. 4 is a perspective view of the appearance of the first example of the push-button switch of the present invention.
Figure 5:
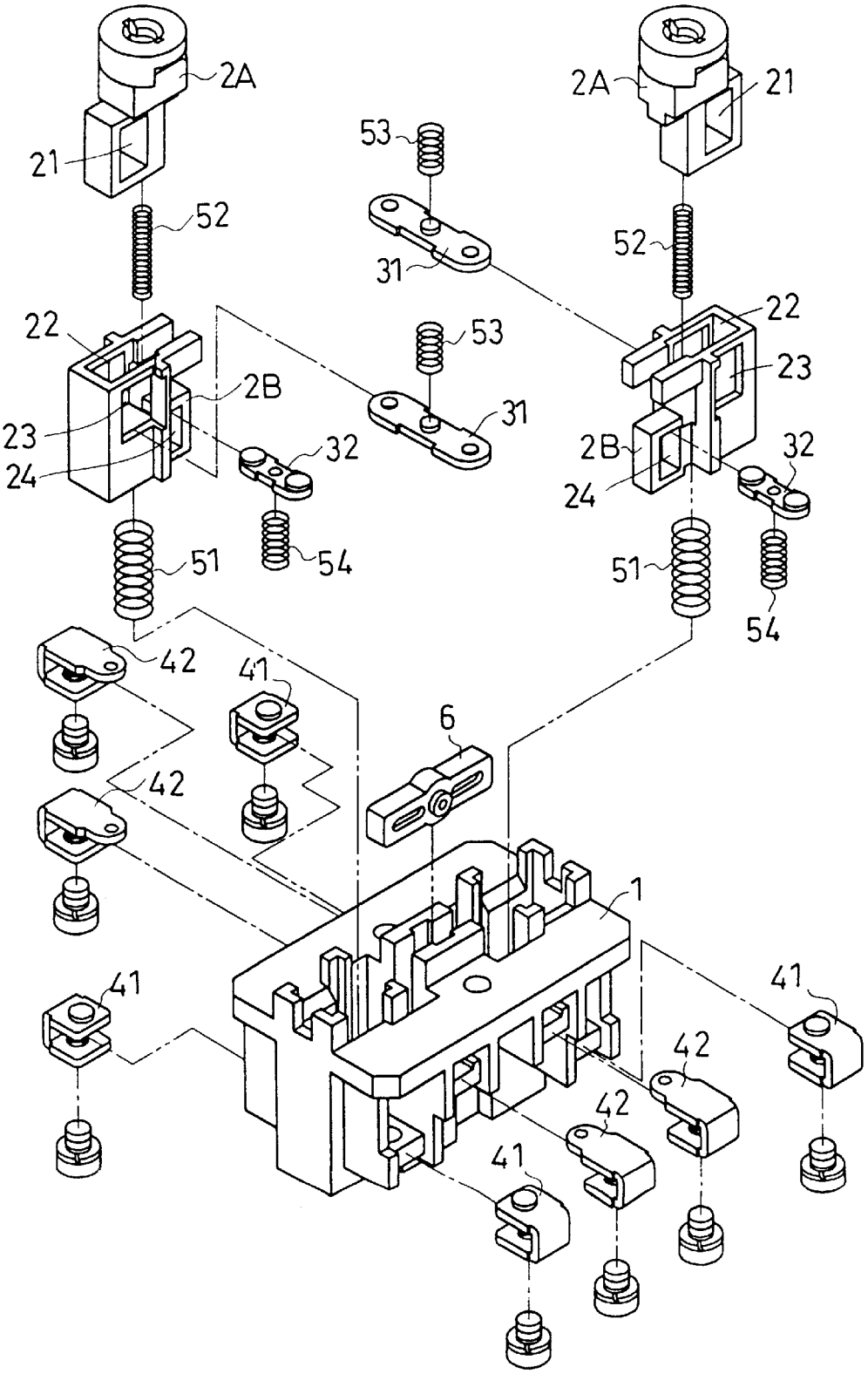
FIG. 5 is a perspective view in disassembled state of the first example of the push-button switch of the present invention.

The push-button switch and the push-button switch device using the push-button switch of the present invention will be explained hereafter based on illustrated examples.

FIG. 1 to FIG. 7 indicate the first example of the push-button switch and the push-button switch device using the push-button switch of the present invention.

This push-button switch 10 is constructed by disposing respectively two push buttons 2, 2 on a breaker plate 1 in a way to face each other, a spring 51, for returning each push button, between the breaker plate 1 and the push buttons 2, 2 and an interlock 6 for preventing the two push buttons 2, 2 from being pressed down simultaneously.

This construction is made by disposing, on the breaker plate 1, two pairs of fixed contacts 41 for an operating circuit and two pairs of fixed contacts 42 for a verification circuit. The fixed contacts being fastened by a screw, for example.

Each push button 2 is composed of a push button body 2A slidably provided in a groove 22 which is formed in an auxiliary push button body 2B in the longitudinal direction, and is constructed by disposing mobile contact 31 for the operating circuit in a rectangular hole 21 formed through the push button body 2A in the transverse direction, through a rectangular hole 23 formed through the auxiliary push button body 2B, and by also disposing mobile contact 32 for the verification circuit in a rectangular hole 24 formed through the auxiliary push button body 2B in the transverse direction.

In this case, each push button 2 is constructed by disposing spring 52 for returning the push button body between the push button body 2A and the auxiliary push button body 2B, so that the urging force in the returning direction of the spring 51 for returning the push button provided between the breaker plate 1 and the auxiliary push button body 2B of the push button 2 may act on the auxiliary push button body 2B and, from this auxiliary push button body 2B through the spring 52 for returning the push button body, on the push button body 2A. A spring having an urging force smaller than that of the spring 51 for returning the push button will be used for this spring 52 for returning the push button body.

Moreover, the push button 2 will be provided with spring 53 for mobile contact between the top face of the rectangular hole 21 and the mobile contact 31 for the operating circuit so that the mobile contact 31 for the operating circuit may be constantly urged in the direction of pressing down, and also provided with spring 54 for mobile contact between the bottom face of the rectangular hole 24 and the mobile contact 32 for the verification circuit so that the mobile contact 32 for the verification circuit may be constantly urged in the returning direction, respectively.

While explanation was made on push-button switch 10 having two push buttons 2, 2 facing each other in the present example, the number of push buttons to be provided on the push-button switch 10 is not limited to that number but may also be one piece or no less than 3 pieces.

Figure 6:
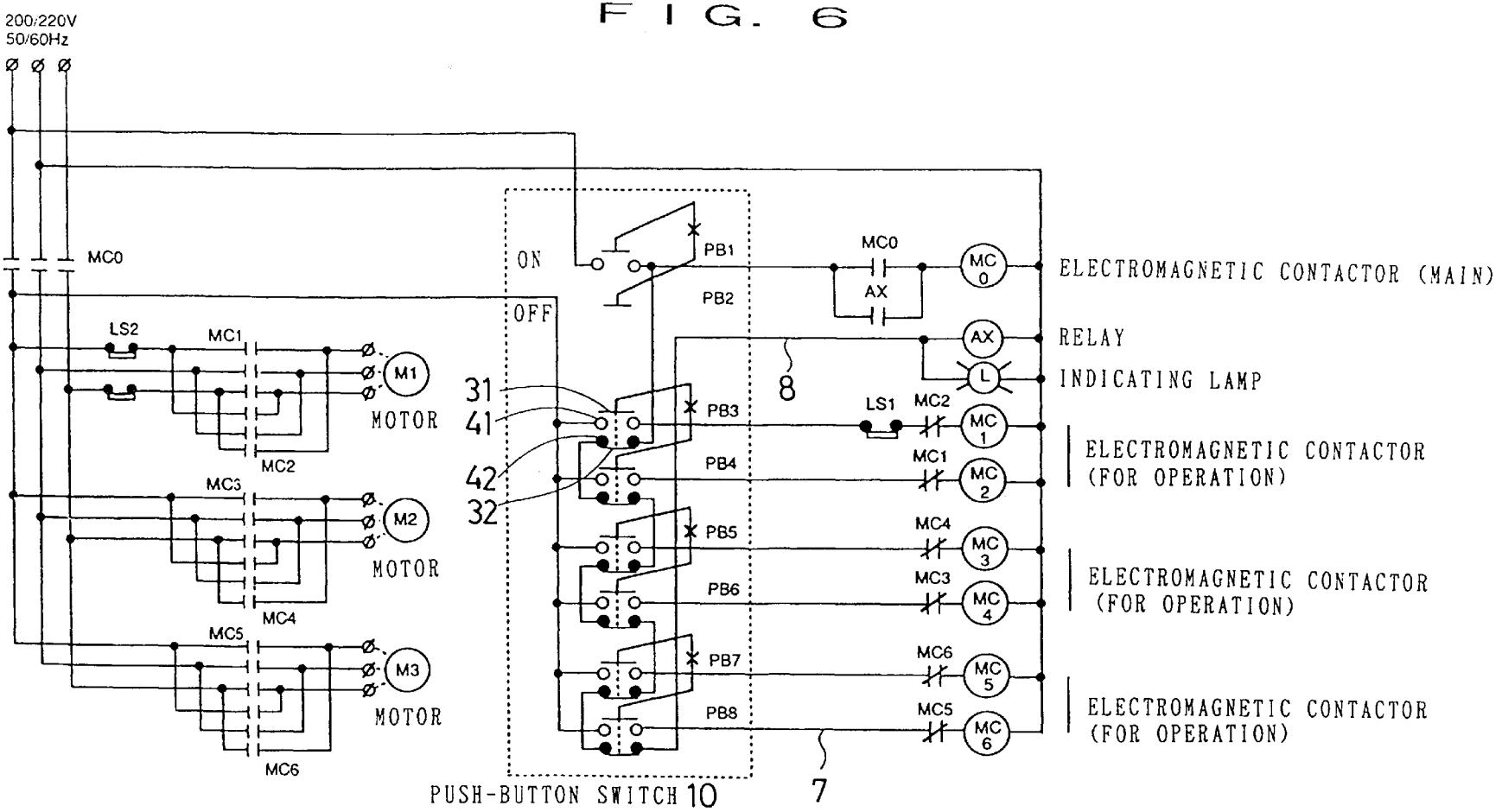
FIG. 6 is a sequence circuit diagram of the push-button switch device of the present invention.

Next, explanation will be given on a case where the push-button switch 10 of the first example is incorporated in a push-button switch device provided with a sequence circuit composed of an operating circuit 7 and a verification circuit 8 as shown in FIG. 6, for example.

Figure 7A:
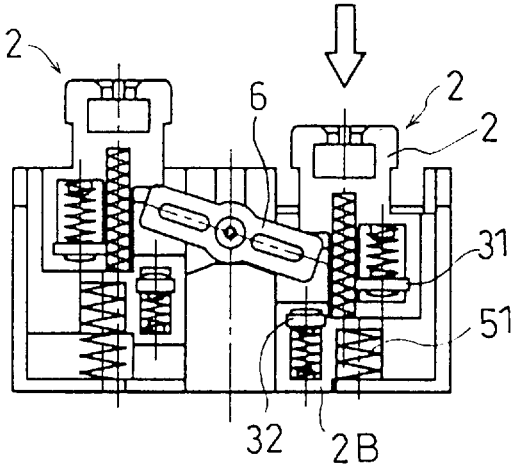
FIGS. 7(*a*)–7(*c*) are an explanatory diagram of the motion of the first example of the push-button switch device of the present invention, FIG. 7(*a*) showing the state where one of the push buttons is pressed down upon normal operation, FIG. 7(*b*) showing a state where the pressing down operation of the push button is released upon an unusual occurrence, and FIG. 7(*c*) showing a state where the other push button is pressed down upon an unusual occurrence.
Figure 7B:
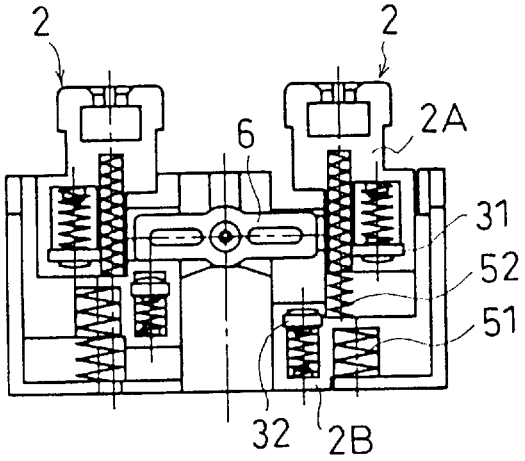
Figure 7C:
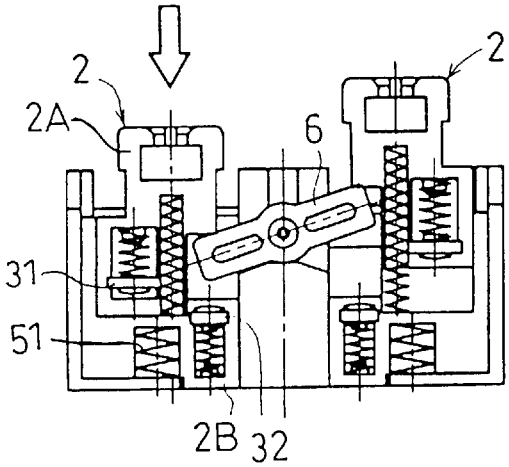

With the use of the push-button switch 10, in the case where the push button 2 of the push-button switch 10 is pressed down (FIG. 7(*a*)) with the main electromagnetic contactor MCO ON and, after that, the pressing down of the push button 2 is released, the contact for the operating circuit is opened, even when the auxiliary push button body 2B in the push button 2 of the pressed push-button switch 10 fails to return because of breaking, for example, of the spring 51 for returning the push button, and the equipment can be automatically stopped even if the operator does not operate the switch PB2 for shutting down power, because the push button body 2A provided with the mobile contact 31 for operating circuit returns by sliding in the groove 22 (FIG. 7(*b*)) formed in the longitudinal direction of the auxiliary push button body 2B with the urging force of the spring 52 for returning the push button body.

In this case, it is desirable to form the gap between the push button body 2A and the sliding part of the auxiliary push button body 2B and of the breaker plate 1 larger than the gap between the auxiliary push button body 2B and the breaker plate 1 to prevent locking of the push button body 2A due to biting of dust, for example, in the push button body 2A. Even with such construction, at normal times, the push button body 2A and the auxiliary push button body 2B move integrally in both pressing down and returning, thus making it possible to secure smooth sliding of the push button body 2A for a long period of time without any deterioration of operability of the push button body 2A.

Moreover, even when the spring 52 for returning push button body is broken or the push button body 2A is locked because of biting of dust, for example, in the sliding part of the push button body 2A, the contact for the operating circuit is opened and the equipment can be automatically stopped even if the operator does not operate the switch PB2 for shutting down power, because the urging force of the spring 51 for returning the push button acts on the auxiliary push button body 2B and, from this auxiliary push button body 2B through the spring 52 for returning the push button body or directly, on the push button body 2A, and the push button body 2A provided with the mobile contact 31 for the operating circuit returns to the normal position together with the auxiliary push button body 2B.

Figure 12:
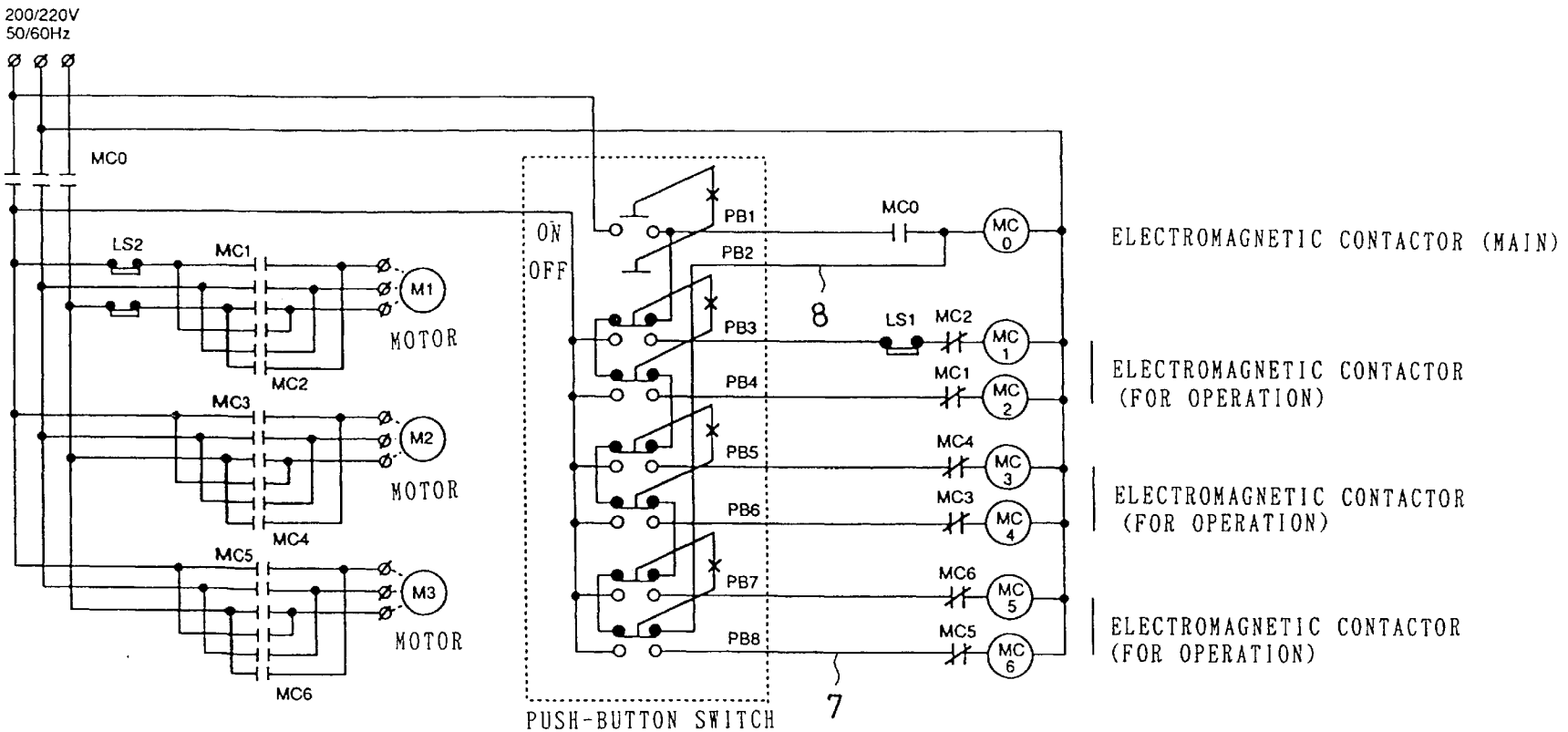
FIG. 12 PRIOR ART
FIG. 12 is a sequence circuit diagram of a conventional push-button switch device.

Furthermore, the sequence circuit indicated in FIG. 6 is constructed, in the same way as the sequence circuit indicated in FIG. 12, in such a way that the main electromagnetic contactor MCO is not turned ON even if the switch PB1 for closing power is operated in the state where the push button 2 of the push-button switch 10 does not return to the normal position because of a failure of the push-button switch 10, in other words, a state where at least one of the contacts for operating circuit is closed. In this case, the contact for the verification circuit corresponding to the closed contact for the operating contact is in the open state. Furthermore, because indicating lamp L for verification is interposed in the verification circuit constructed by connecting the fixed contacts 42 for the verification circuit of the respective push-button switches 10 in series, it becomes possible to judge the presence or not of any failure of the push-button switch 10 for operating equipment prior to the occurrence of a situation where the equipment does not stop even if the push button 2 of the push-button switch 10 for operating the equipment is released from the pressed state, because the indicating lamp L for verification does not light upon the occurrence of anything unusual in the returning state of the push button of the push-button switch in the state where the main electromagnetic contactor MCO is ON, in other words, when the contact for the verification circuit is not closed (FIGS. 7(*b*) and (*c*)). In the state where the main electromagnetic contactor MCO is ON, it is possible to drive the equipment again by either pressing down the push button 2 of the push-button switch 10 again or, as shown in FIG. 7(*c*), pressing down the other push button 2.

Figure 8A:
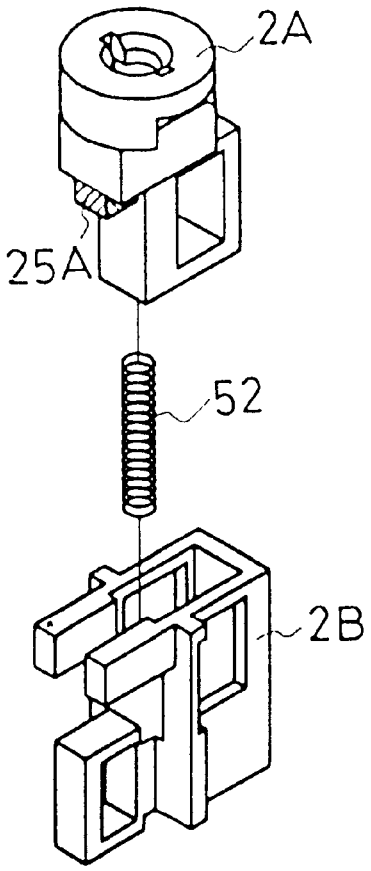
FIGS. 8(*a*) and 8(*b*) show the contact face of the interlock, FIG. 8(*a*) representing the first example of the push-button switch device of the present invention, and FIG. 8(*b*) the second example of the push-button switch device of the present invention.
Figure 8B:
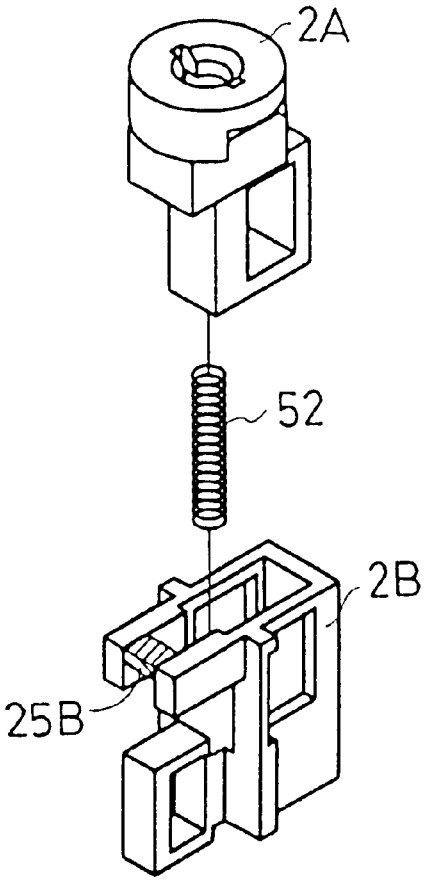

By the way, in the push-button switch of the first example, contact face 25A of the interlock 6 was formed on the bottom face in the intermediate step of the push button body 2A as shown in FIG. 8(*a*), but, instead, contact face 25B of the interlock 6 may be formed on the bottom face in the upper step of the auxiliary push button body 2B, as in the second example of the push-button switch of the present invention indicated in FIG. 8(*b*).

Figure 9A:
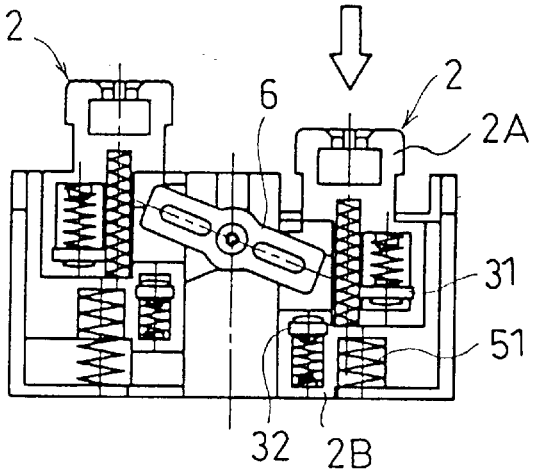
FIGS. 9(*a*)–9(*c*) are an explanatory diagram of the notion of the second example of the push-button switch device of the present invention, FIG. 9(*a*) showing the state where one of the push buttons is pressed down (upon normal operation), FIG. 9(*b*) a state where the pressing down operation of the push button is released (upon an unusual occurrence), and FIG. 9(*c*) a state where the other push button is pressed down (upon an unusual occurrence).
Figure 9B:
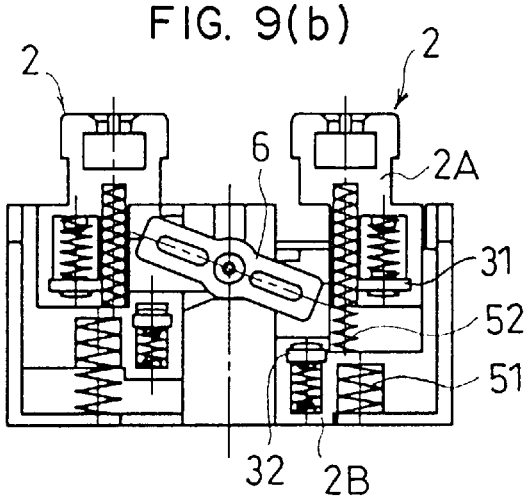
Figure 9C:
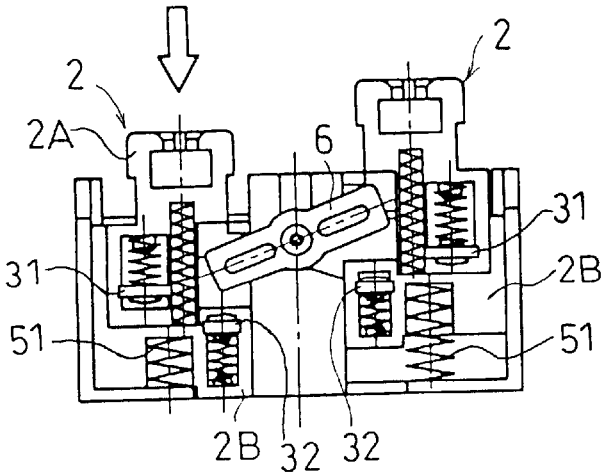

By forming the contact face 25B of the interlock 6 on the bottom face in the upper step of the auxiliary push button body 2B, like the push-button switch of this second example, in the case where the push button 2 of the push-button switch 10 is pressed down (FIG. 9(*a*)) with the main electromagnetic contactor MCO ON and, after that, the pressing down of the push button 2 is released, in the same way as the push-button switch of said first example, the contact for the operating circuit is opened, even when the auxiliary push button body 2B in the push button 2 of the pressed push-button switch 10 fails to return because of breaking, for example, of the spring 51 for returning the push button, and the equipment can be automatically stopped even if the operator does not operate the switch PB2 for shutting down power, because the push button body 2A provided with the mobile contact 31 for operating circuit returns by sliding in the groove 22 formed in the longitudinal direction of the auxiliary push button body 2B with the urging force of the spring 52 for returning the push button body. Furthermore, as shown in FIG. 9(*c*), by pressing down the other push button 2, it becomes possible to make the auxiliary push button body 2B, which failed to return to the normal position, return as an emergency measure, through the interlock 6.

Other motions of the push-button switch of this example are the same as those of the push-button switch of the first example, and the push-button switch can be used by being incorporated in a push-button switch device provided with a sequence circuit consisting of an operating circuit 7 and a verification circuit 8, as shown in FIG. 6.

Figure 10A:
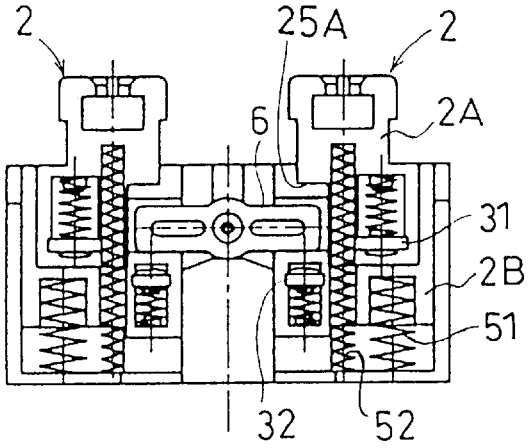
FIGS. 10(*a*)–10(*c*) are an explanatory diagram of the motion of the third example of the push-button switch device of the present invention, FIG. 10(*a*) showing the state where no operation is made, FIG. 10(*b*) a state where one of the push buttons is pressed down (upon normal operation), and FIG. 10(*c*) a state where the pressing down operation of the push button is released (upon an unusual occurrence).
Figure 10B:
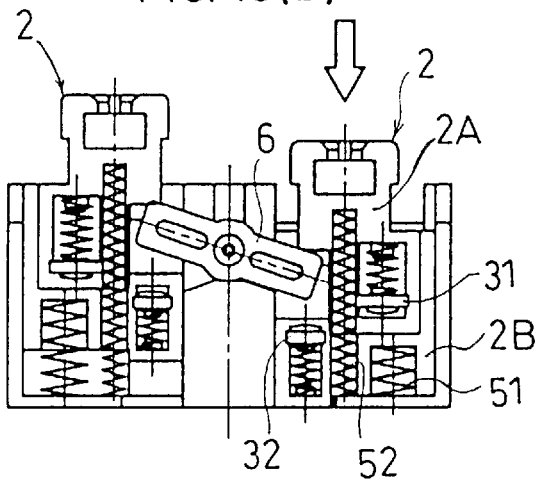
Figure 10C:
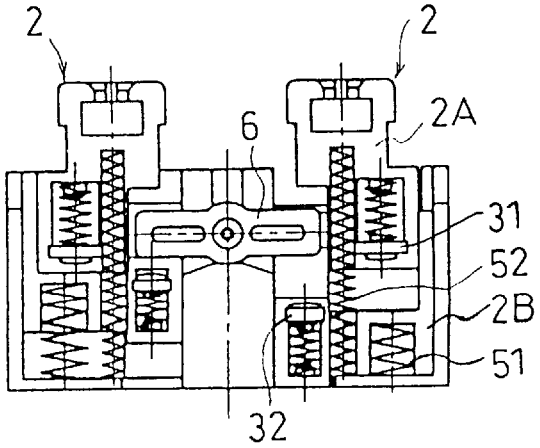
Figure 11A:
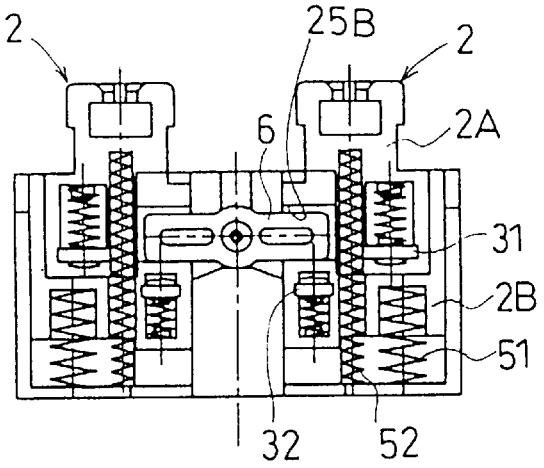
FIGS. 11(*a*)–11(*c*) are an explanatory diagram of the motion of the fourth example of the push-button switch device of the present invention, FIG. 11(*a*) showing the state where no operation is made, FIG. 11(*b*) a state where one of the push buttons is pressed down (upon normal operation), and FIG. 11(*c*) a state where the pressing down operation of the push button is released (upon an unusual occurrence).
Figure 11B:
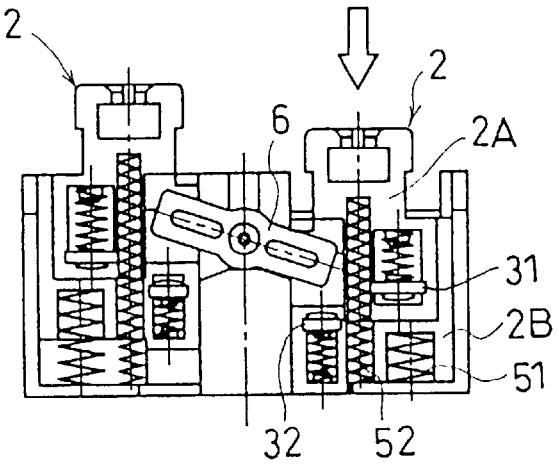
Figure 11C:
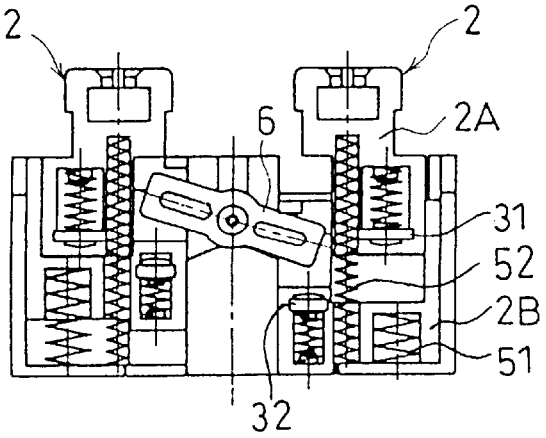

Moreover, while in the push-button switch of the first and second examples the push button 2 was constructed by disposing spring 52 for returning the push button body, of an urging force smaller than that of the spring 51 for returning push button, between the push button body 2A and the auxiliary push button body 2B, so that the urging force in the returning direction of the spring 51 for returning the push button provided between the breaker plate 1 and the auxiliary push button body 2B of the push button 2 may act on the auxiliary push button body 2B and, from this auxiliary push button body 2B through the spring 52 for returning the push button body, on the push button body 2A, it is also possible, instead of doing so, to dispose the spring 52 for returning the push button body between the breaker plate 1 and the push button body 2A of the push button 2, as in the third and fourth examples of the push-button switch of the present invention indicated in FIG. 10(*a*) and FIG. 11(*a*).

By thus disposing the spring 52 for returning push button body between the breaker plate 1 and the push button body 2A of the push button 2, it becomes possible to set the urging force, in other words, the spring constant of the spring 51 for the returning push button and the spring 52 for returning the push button body, as desired.

In the third example indicated in FIG. 10(*a*), contact face 25A of the interlock 6 is formed on the bottom face in the intermediate step of the push button body 2A in the same ways in the first example, while on the other hand the fourth example indicated in FIG. 11(*a*) is a case where contact face 25B of the interlock 6 is formed on the bottom face in the upper step of the auxiliary push button body 2B as in the second example.

By disposing the spring 52 for returning the push button body between the breaker plate 1 and the push button body 2A of the push button 2, as in this push-button switch of the third and fourth examples, in the case where the push button 2 of the push-button switch 10 is pressed down (FIG. 10(*b*), FIG. 11(*b*)) with the main electromagnetic contactor MCO ON and, after that, the pressing down of the push button 2 is released, in the same way as the push-button switch of the first example, the contact for operating circuit is opened, even when the auxiliary push button body 2B in the push button 2 of the pressed push-button switch 10 fails to return because of breaking, for example, of the spring 51 for returning the push button, and the equipment can be automatically stopped even if the operator does not operate the switch PB2 for shutting down power, because the push button body 2A provided with the mobile contact 31 for the operating circuit returns by sliding in the groove 22 (FIG. 10(*c*), FIG. 11(*c*)) formed in the longitudinal direction of the auxiliary push button body 2B with the urging force of the spring 52 for returning the push button body.

What is claimed is:

1. A push-button switch comprising:

a breaker plate having two pairs of first fixed contacts and two pairs of second fixed contacts;

two push-buttons provided on said breaker plate, each push-button having a first spring for urging the push-button in a return direction, and each push-button for being pressed in resistance to the respective first spring;

an interlock provided between said two push-buttons for preventing said two push-buttons from being pressed down simultaneously;

wherein each of said two push-buttons includes a push-button body and an auxiliary push-button body slidably disposed against said push-button body;

wherein said push-button body includes a first mobile contact for contacting one pair of said first fixed contacts of said breaker plate, and said auxiliary push-button body includes a second mobile contact for contacting one pair of said second fixed contacts of said breaker plate; and wherein said push-button body and said auxiliary push-button body are urged in the return direction by said respective first spring, and said push-button body is also urged in the return direction by a respective second spring having a smaller urging force than the urging force of the respective first spring.

2. A push-button switch device including a plurality of push-button switches as defined in claim 1, said device also including:

an operation circuit and a verification circuit;

said operation circuit being closed by contact between said first mobile contact of said push-button body and one pair of said first fixed contacts of said breaker plate, of at least one of said plurality of push-button switches;

said verification circuit being closed by contact between said second mobile contact of said auxiliary push-button body and one pair of said second fixed contacts of said breaker plate, of at least one of said plurality of push-button switches; and said verification circuit comprising said two pairs of second fixed contacts of respective push-button switches connected in series with an indicating lamp, common to the respective push-button switches, for verification.

* * * * *